US006718154B2

(12) United States Patent
Hayashida

(10) Patent No.: US 6,718,154 B2
(45) Date of Patent: Apr. 6, 2004

(54) IMAGE FORMING APPARATUS AND METHOD HAVING A CLEANING DEVICE WITH A CONDUCTIVE MEMBER HAVING A POTENTIAL EQUAL TO A FIRST REMOVING SECTION

(75) Inventor: Masatoshi Hayashida, Kawasaki (JP)

(73) Assignees: Kabushiki Kaisha Toshiba, Tokyo (JP); Toshiba Tec Kabushiki Toshiba, Toyko (JP)

( * ) Notice: Subject to any disclaimer, the term of this patent is extended or adjusted under 35 U.S.C. 154(b) by 0 days.

(21) Appl. No.: 10/200,215

(22) Filed: Jul. 23, 2002

(65) Prior Publication Data

US 2004/0018033 A1 Jan. 29, 2004

(51) Int. Cl.[7] ..... G03G 21/00
(52) U.S. Cl. ..... 399/349; 399/354
(58) Field of Search ..... 399/349, 353, 399/354, 350

(56) References Cited

U.S. PATENT DOCUMENTS 4,506,975 A * 3/1985 Shukuri et al. ..... 399/354
5,148,227 A * 9/1992 Senba et al. ..... 399/349
6,480,695 B2 * 11/2002 Endo et al. ..... 399/349

FOREIGN PATENT DOCUMENTS

JP 1-60148 12/1989

* cited by examiner

*Primary Examiner*—William J. Royer
(74) *Attorney, Agent, or Firm*—Foley & Lardner

(57) ABSTRACT

A cleaning device in an image forming apparatus, which performs cleaning, includes a roll-shaped electrically conductive brush grounded via a varistor (non-linear resistor element), a flicker metal rod which is put in pressure contact with the electrically conductive brush and connected to have a potential equal to a potential of the electrically conductive brush, and a cleaning blade formed of an elastic material.

12 Claims, 4 Drawing Sheets

Min REFLECTANCE : START OF ROTATION
Max REFLECTANCE : END OF ROTATION
MIDDLE REFLECTANCE : INTERMEDIATE BETWEEN Min AND Max

IMAGE FORMING APPARATUS AND METHOD HAVING A CLEANING DEVICE WITH A CONDUCTIVE MEMBER HAVING A POTENTIAL EQUAL TO A FIRST REMOVING SECTION

BACKGROUND OF THE INVENTION

The present invention relates to a cleaning apparatus and a cleaning method for an image forming apparatus such as an electronic copying machine according to an electrophotographic system, which has a cleaning device and forms an electrostatic latent image on a photosensitive drum to produce an image.

In the prior art, charging is effected on a photosensitive drum in an electronic copying machine, a latent image on the photosensitive drum is developed using toner, the developed toner image is transferred on transfer paper, and the charge on the photosensitive drum is erased.

After the toner image has been transferred on the transfer paper, a slight amount of toner and a slight amount of paper dust remain on the surface of the photosensitive drum. To remove them, a cleaning device is provided.

A cleaning mechanism conventionally known as a cleaning device for removing the toner and paper dust comprises a roll-shaped electrically conductive brush, provided on the downstream side of a transfer/separation charger, and an elastic cleaning blade provided on the downstream side of the electrically conductive brush.

The toner and paper dust remaining on the surface of the photosensitive drum after the transfer is partly removed by the electrically conductive brush and then further removed by the cleaning blade put in contact with the surface of the photosensitive drum.

Depending on the amount of toner removed by the electrically conductive brush (roller), the edge portion of the cleaning blade may apply a great stress on the photosensitive drum, and removal of the paper dust may be more difficult than that of toner. To solve this problem, a power supply applies a bias voltage, which is of an opposite polarity to the electricity of paper dust, to the electrically conductive brush, whereby the paper dust is electrostatically removed by the electrically conductive brush before it reaches the cleaning blade.

However, another power supply is required for a bias to be applied to the electrically conductive brush. This results in an increase in cost. In addition, in a case where a voltage level at the time of turn-on of bias is always constant, the removal performance for residual toner and paper dust varies depending on the potential level of the photosensitive drum at the position of the electrically conductive brush. Thus, there is a problem with the compatibility of removal performances of both cleaning mechanisms.

Specifically, if the toner removal performance is too good under the condition that the electrically conductive brush is grounded, no toner will reach the edge portion of the cleaning blade in the next step and this will lead to excessive friction of the edge portion. Furthermore, flaws will easily occur on the surface of the photosensitive drum due to positively (+) charged paper dust on the negatively (−) charged surface of the photosensitive drum.

If a fixed bias voltage (−) is applied to the electrically conductive brush by the external power supply and the removal performance level for toner (−) is lowered, the toner removal performance of the electrically conductive brush at the time of total-surface printing is considerably degraded.

BRIEF SUMMARY OF THE INVENTION

The object of the present invention is to provide a cleaning device and a cleaning method for an image forming apparatus, which can stably maintain the performance of removing residual toner and paper dust.

In order to achieve the object, there is provided a cleaning device for removing toner and paper dust remaining on a photosensitive drum in an image forming apparatus which forms an image using the photosensitive drum, the cleaning device comprising: a first removing section which is grounded via a non-linear resistor element and removes toner and paper dust remaining on a surface of the photosensitive drum; and a second removing section which, following the first removing section, removes the toner and paper dust remaining on the surface of the photosensitive drum.

There is also provided a cleaning method for removing toner and paper dust remaining on a photosensitive drum in an image forming apparatus which forms an image using the photosensitive drum, the method comprising: removing toner and paper dust remaining on a surface of the photosensitive drum, using a roll-shaped electrically conductive brush grounded via a varistor; and removing the toner remaining on the surface of the photosensitive drum, which still remains after the removal, using a cleaning blade formed of an elastic material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
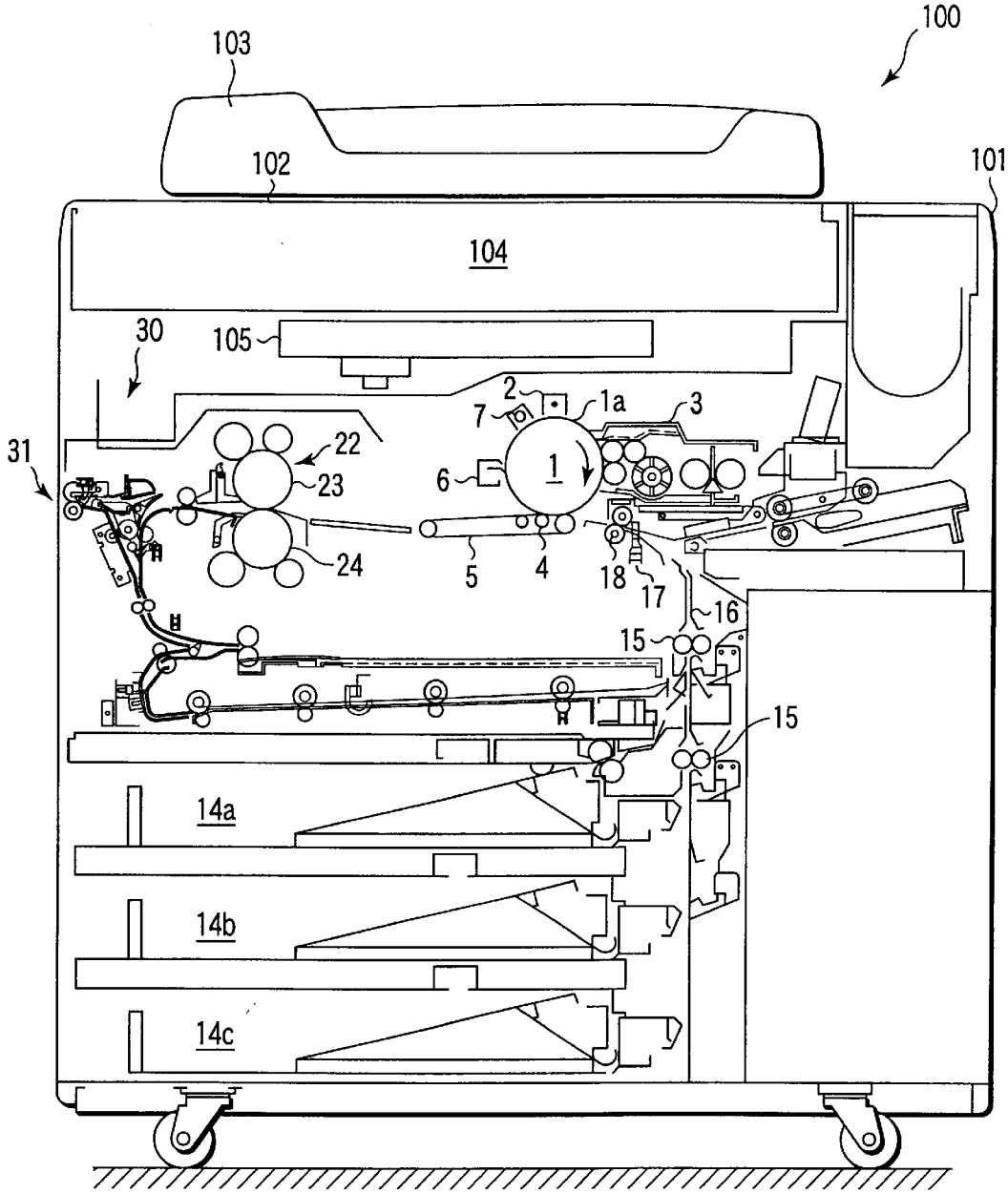
FIG. 1 is a cross-sectional view showing an internal structure of a digital multi-function peripheral according to an image forming apparatus of the present invention.

FIG. 1 is a cross-sectional view showing an internal structure of a digital multi-function peripheral (MFP) 100.

The digital MFP 100 has a casing 101 that is an outside frame of the apparatus. An original table glass 102 for placement of an original is provided on top of the casing 101. An automatic original document feeder (ADF) 103 is openably provided on the original table glass 102. The ADF 103 covers the original set on the original table glass 102 and automatically feeds the original to a predetermined position on the original table glass 102.

A scanner unit 104 is provided within the casing 101 below the original table glass 102. The scanner unit 104 illuminates the original set on the original table glass 102 and receives reflection light, thereby reading an image of the original. An exposing unit 105 is provided below the scanner unit 104. The exposing unit 105 radiates a laser beam, which is based on image data read by the scanner unit 104, onto a drum surface Ia of a photosensitive drum 1, and scans the drum surface Ia with the beam. Thus, an electrostatic latent image based on the image data is formed on the drum surface Ia. Detailed structures of the scanner unit 104 and exposing unit 105 do not relate to the subject matter of the present invention and are not shown in the drawing.

Around the photosensitive drum 1, other structural elements for executing a well-known electrophotographic process are provided. That is, a charger 2, a developing device 3, a transfer bias applying roller 4, a transfer belt 5, a cleaning device 6, and a charge erase lamp 7 are provided.

The charger 2 electrifies the drum surface 1*a* with a predetermined potential. The developing device 3 supplies a developer agent to an electrostatic latent image formed on the drum surface 1*a* by exposure scan by the exposing unit 105. Thus, the developing device 3 forms a developer image based on image data. The transfer bias applying roller 4 applies charge on a paper sheet that is fed through a transfer region provided between the transfer bias applying roller 4 and the photosensitive drum 1, thereby electro-statically transferring the developer image from the drum surface 1*a* onto the sheet. As will be described later in detail, the cleaning device 6 removes toner and paper dust remaining on the drum surface 1*a* after the transfer. The charge erase lamp 7 erases the charge on the drum surface 1*a*.

Sheet feed cassettes 14*a*, 14*b* and 14*c* containing paper sheets of different sizes and sorts are arranged in multiple stages below the photosensitive drum 1. Paper sheets taken out of the sheet feed cassettes 14*a*, 14*b* and 14*c* are fed toward the photosensitive drum 1 via a sheet convey path 16 equipped with pairs of sheet feed rollers 15.

The sheet fed toward the photosensitive drum 1 passes by an aligning switch 17 and is once aligned by aligning rollers 18. In synchronism with movement of a developer image on the drum surface 1*a*, the aligning rollers 18 are rotated and the aligned sheet is fed to a transfer region. At this time, a charge is applied by the transfer bias applying roller 4, and the developer image formed on the drum surface 1*a* is transferred onto the sheet. The speed at which the sheet is fed to the transfer region is set to be equal to a peripheral speed of the photosensitive drum 1, that is, a process speed at the time the electro-photographic process is executed.

The sheet, which has passed through the transfer region and on which the developer image has been transferred, is conveyed to a fixing device 22 via the transfer belt 5 with the process speed maintained. The fixing device 22 comprises a heat roller 23 provided above the sheet convey path 16 and a pressing roller 24 put in pressure contact with the heat roller 23 with the sheet convey path 16 interposed. The sheet, which has passed through a nip between the rollers 23 and 24 of the fixing device 22 and on which the developer image has been fixed, is discharged to the outside of the apparatus through a discharge port 31 formed in the casing 101 by means of a sheet discharge mechanism 30 (hereinafter referred to as "discharge mechanism 30").

Figure 2:
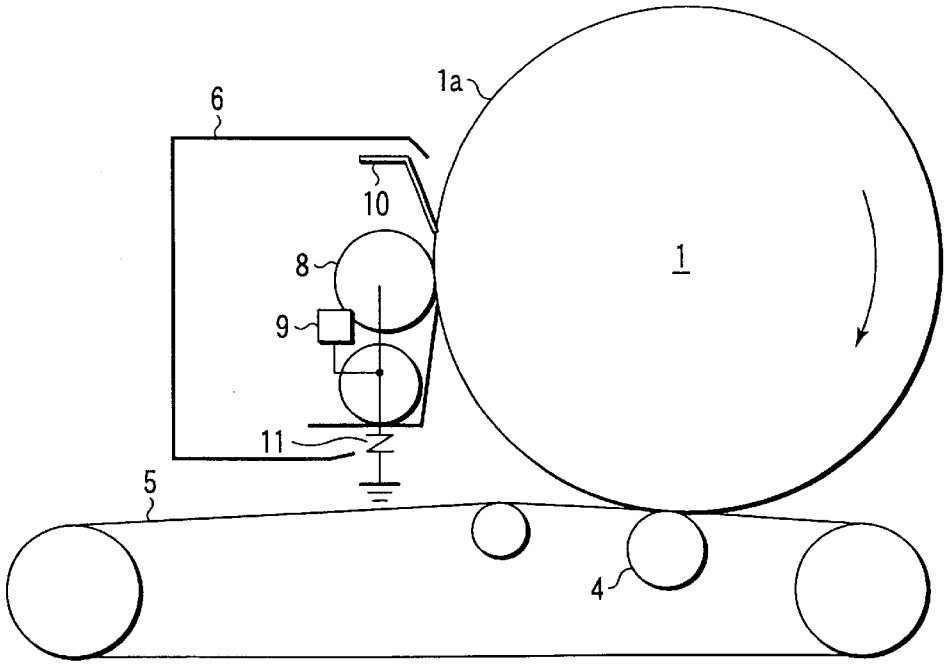
FIG. 2 shows the structures of a cleaning device and peripheral components thereof.

FIG. 2 shows the structures of the cleaning device 6 and peripheral components thereof.

As is shown in FIG. 2, the cleaning device 6 is disposed on the downstream side of the transfer belt 5 in the rotational direction of the photosensitive drum 1 that is rotated in the direction indicated by the arrow.

The cleaning device 6 comprises a roll-shaped electrically conductive brush 8 grounded via a varistor (non-linear resistor) 11, a flicker metal rod (metal flicker bar) 9 provided in pressure contact with the conductive brush 8 and connected to have a potential equal to the potential of the conductive brush 8, and a cleaning blade 10 formed of an elastic material.

A toner recovery auger (not shown) is provided in order to discharge toner recovered by the conductive brush 8.

Figure 3:
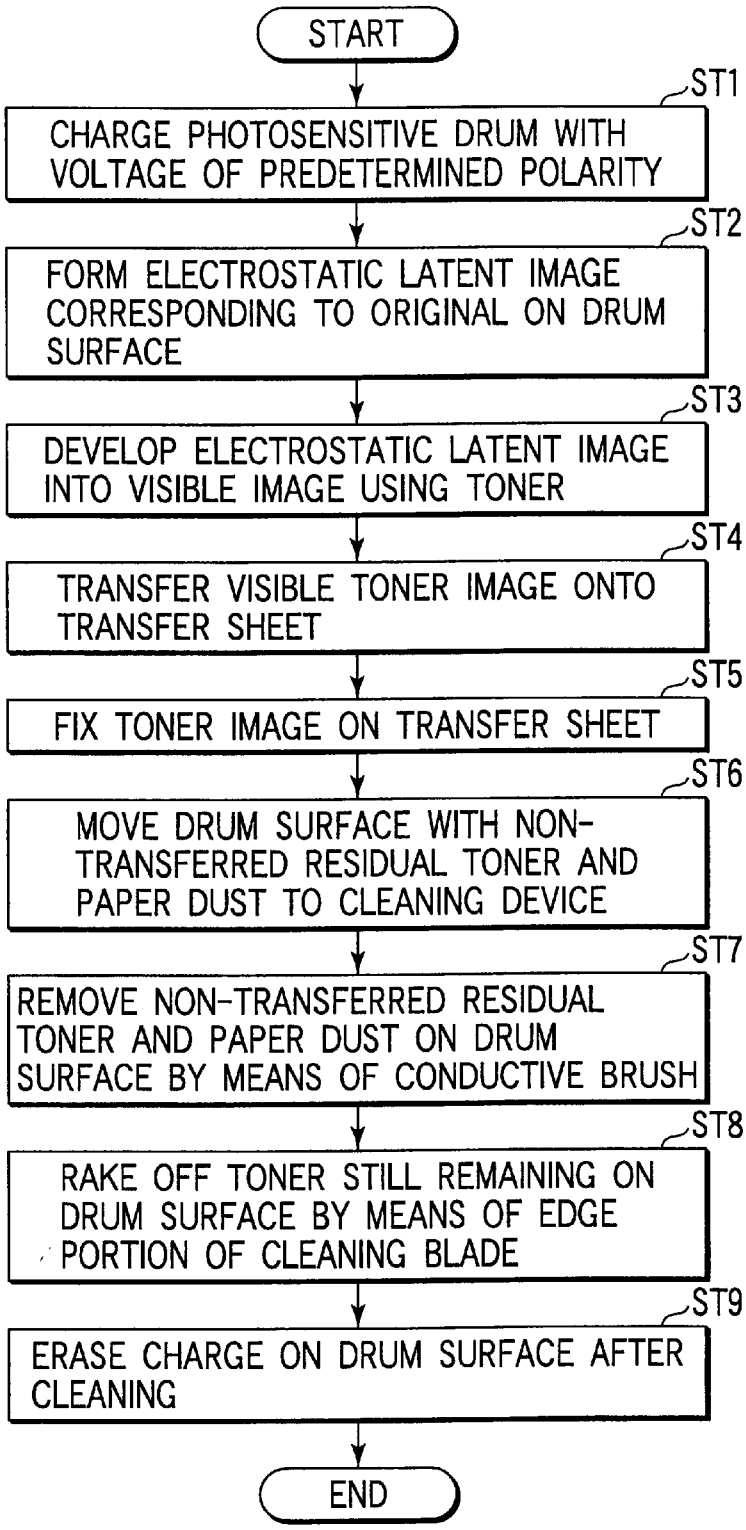
FIG. 3 is a flow chart illustrating a copying operation using the cleaning device.

The copying operation (image forming operation) using the cleaning device 6 will now be described with reference to a flow chart of FIG. 3.

The photosensitive drum 1 is charged with a voltage of predetermined polarity, e.g. −600V, by the charger 2 (ST1). An electrostatic latent image corresponding to an original document is formed on the drum surface 1*a* by the exposing unit 105 (ST2). The electrostatic latent image is supplied with toner and developed into a visible image by the developing device 3 (ST3). The charge quantity of a two-component developer toner, which is used in the present embodiment, is about (−) 20–30 $\mu$C/g.

Subsequently, the toner image is efficiently transferred to a transfer sheet by the transfer belt 5 that rotates in contact with the drum surface I*a* of photosensitive drum 1 (ST4). The transfer sheet on which the toner image has been transferred is separated from the photosensitive drum 1 by an electrostatic attraction force acting between the transfer belt 5 and a sheet. The transfer sheet is then conveyed to a fixing device 22, and the toner image is fixed by the fixing device 22 (ST5).

On the other hand, the drum surface 1*a* of the rotating photosensitive drum 1, on which non-transferred residual toner remains, is moved to the cleaning device 6 (ST6).

In the cleaning device 6, the electrically conductive brush 8 removes the non-transferred residual toner and paper dust (ST7). The toner, which has not been removed by the conductive brush 8 and still remains, is raked off by the edge portion of the cleaning blade 10 positioned on the downstream side of the conductive brush 8 (ST8).

The charge on the cleaned drum surface 1*a* is erased by the charge erase lamp 7 (ST9), and the drum surface 1*a* is set at a uniform and low potential for the next copying cycle.

The remarkable point of the cleaning device 6 of the present invention is that the conductive brush 8 is grounded via the varistor 11.

Depending on a potential level of the drum surface Ia positioned at the conductive brush 8, a current flows in the 400V-varistor 11 connected to the conductive brush 8. This current functions as a bias.

Figure 4:
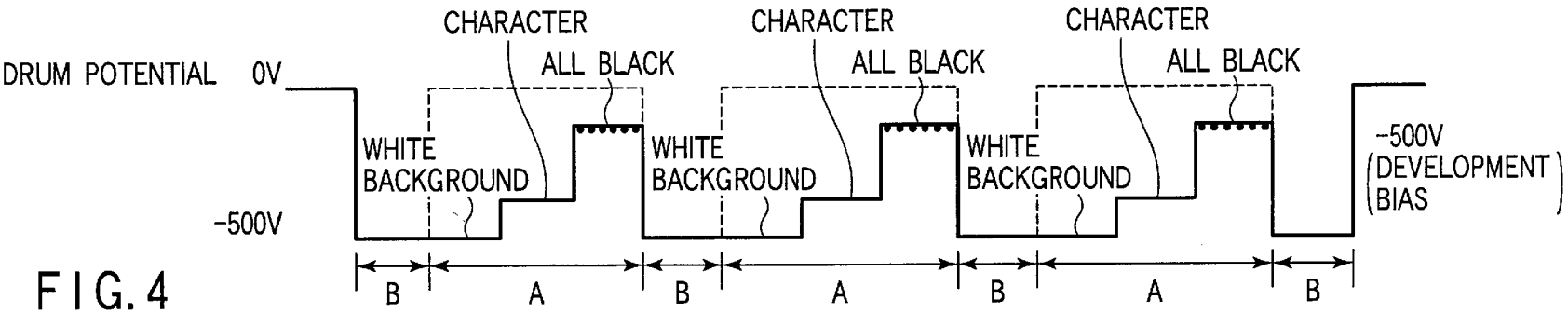
FIG. 4 is a graph showing the relationship between the drum surface potential and the conductive brush potential.

As is shown in FIG. 4, a non-image portion B (a portion between sheets) on the drum surface 1*a* of photosensitive drum 1 has a potential corresponding to the timing at which the transfer application is turned off at the transfer position. Thus, this potential is substantially equal to the potential at a development position and is about −500V. At the time the non-image portion B of drum surface 1*a* has reached the position of the conductive brush 8, a bias potential of −400V occurs in the conductive brush 8, as shown in FIG. 5.

As a result, a potential difference between the drum surface Ia and conductive brush 8 decreases. Consequently, a small amount of toner adhering to the non-image portion B of drum surface Ia is hardly recovered or removed by the conductive brush 8. The drum surface Ia, with the small amount of toner remaining, reaches the edge portion of cleaning blade 10. This reduces the friction at the edge portion of the cleaning blade 10, enhancing anti-friction properties of drum surface Ia and contributing to chattering of cleaning blade 10.

Figure 5:
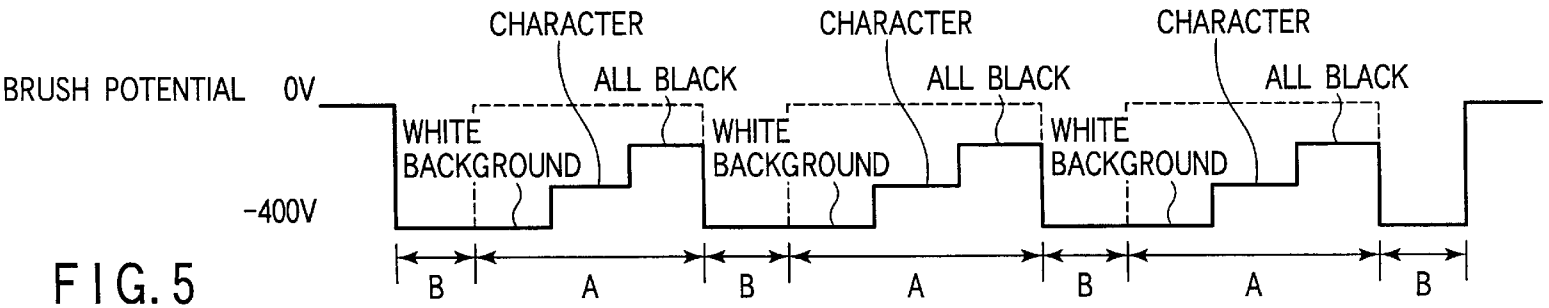
FIG. 5 is a graph showing the relationship between the drum surface potential and the conductive brush potential.

Of course, as shown in FIG. 5, the potential of an image portion (a portion corresponding to a sheet) on the drum surface 1*a* varies in the range of about −100V to about −500V depending on the kind of a printed original. However, in consideration of the way of use in the product market, it is assumed that the frequency of use for general character-printed originals is high. At the time of the character printing, the potential of the image portion A on drum surface 1*a* is substantially equal to that of the non-image portion B, except for the character portions. Accordingly, the bias potential of the conductive brush 8 is equal to the level in the case of the non-image portion B, and an appropriate amount of toner reaches the cleaning blade 10. Similarly, the same advantages as mentioned above are obtained.

Paper dust (+) adhering to the image portion A (sheet portion) on the drum surface 1*a* can be removed by the bias potential (−) of conductive brush 8.

On the other hand, in a case where a printed original has an entire toner-printed surface (e.g. all black surface), the potential of the image portion A on drum surface 1*a* is low and about −100V. Since the absolute value of the bias potential of conductive brush 8 becomes low and about −100V or more, the toner on the printed portion (−) can easily be removed.

Figure 6:
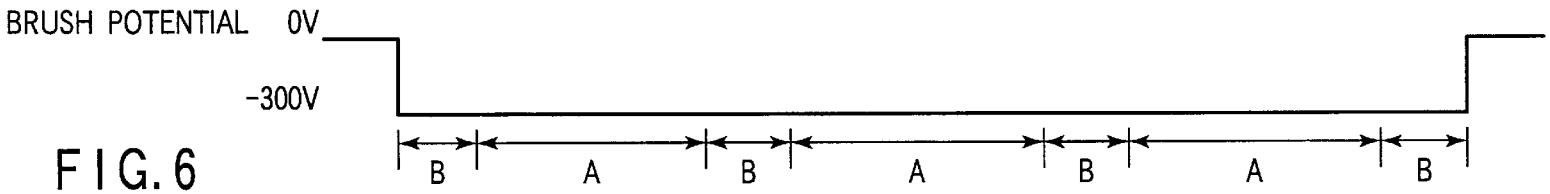
FIG. 6 is a graph showing the relationship between the drum surface potential and the conductive brush potential.

FIG. 6 shows a potential of a prior-art electrically conductive brush. In this case, the above problems arise since both the image portion A and non-image portion B are set at about −300V.

Figure 7:
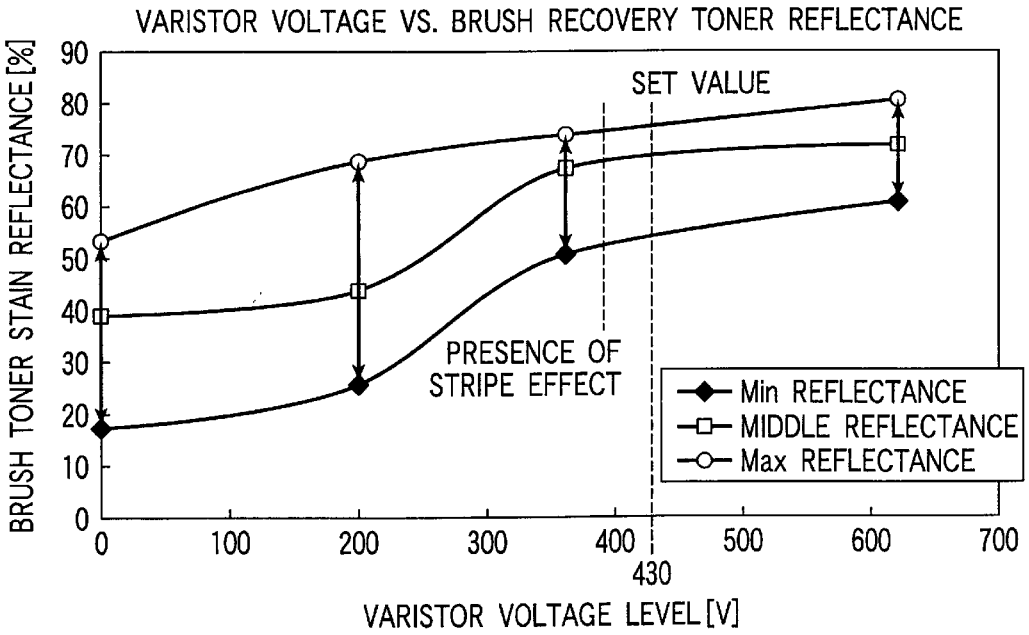
FIG. 7 shows the relationship between a varistor voltage and the amount of recovered toner.

FIG. 7 shows measured results about the relationship between the voltage level of the varistor 11 connected to the conductive brush 8 and the amount of toner cleaned and recovered by the conductive brush 8. In FIG. 7, a Min reflectance indicated by a diamond mark is associated with the start of rotation of conductive brush 8, a Max reflectance indicated by a circular mark is associated with the end of rotation of conductive brush 8, and a middle reflectance indicated by a square mark is associated with an intermediate point between the Min reflectance and Max reflectance.

From FIG. 7, it is understood that the lower the voltage level of varistor 11, the greater the amount of toner cleaned and recovered by the conductive brush 8.

In FIG. 7, the abscissa plots the voltage level of the varistor 11, and the ordinate the amount (relative amount) of toner recovered on the conductive brush 8. The recovered toner amount (relative value) is evaluated such that the conductive brush 8, which has recovered toner, is rotated over the transfer sheet and the toner stain adhering to the sheet surface is measured by a reflectometer. Thus, data with lower reflectance indicates a greater amount of toner captured by the conductive brush 8 and a smaller amount of toner that reaches the cleaning blade 10.

Based on this data, paper feed tests were conducted using the actual digital MFP 100, and flaws on the drum surface 1*a* were examined. It was understood that flaws on the drum surface 1*a* were prevented by connecting the varistor 11 of 300V or more between the conductive brush 8 and the ground.

A bias potential is produced in the conductive brush 8 due to the varistor 11. Thus, it is necessary that the flicker metal rod 9 put in pressure contact with the conductive brush 8 be electrically floated or set at a potential equal to that of the conductive brush 8. In this invention, the flicker metal rod 9 is connected to have the same potential as the conductive brush 8.

On the other hand, when the flicker metal rod 9 is grounded, the bias charge accumulated in the varistor 11 by the surface potential of the photosensitive drum 1 leaks via the flicker metal rod 9, and a bias voltage of the conductive brush 8 cannot be obtained. Thus, it is not preferable to ground the flicker metal rod 9.

As has been described above, the structure of the embodiment is inexpensive since a bias power supply for applying a voltage to the conductive brush (roller) 8 is not required.

The bias voltage of the conductive brush (roller) 8 is adaptively varied in accordance with the surface potential of the photosensitive drum 1 opposed to the conductive brush 8. Thus, an appropriate amount of toner can be supplied to the cleaning blade 10, and the cleaning performance for paper dust enhanced.

Thereby, flaws on the drum surface 1*a* can be prevented.

Besides, chattering of the cleaning blade 10 can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cleaning device for removing toner and paper dust remaining on a photosensitive drum in an image forming apparatus which forms an image using the photosensitive drum, the cleaning device comprising:

a first removing section which is grounded via a non-linear resistor element to generate a bias potential whose polarity is the same as that of charged toner, and removes toner and paper dust remaining on a surface of the photosensitive drum;

a conductive member which is put in pressure contact with the first removing section and connected via the non-linear resistor element to have a potential equal to that of the first removing section; and a second removing section which, following the first removing section, removes the toner and paper dust remaining on the surface of the photosensitive drum.

2. A cleaning device according to claim 1, wherein said non-linear resistor element is a varistor.

3. A cleaning device according to claim 1, wherein said first removing section is a roll-shaped electrically conductive brush.

4. A cleaning device according to claim 1, wherein said second removing section is a cleaning blade formed of an elastic material.

5. A cleaning device according to claim 1, wherein the bias potential of the first removing section is substantially the same in voltage level as that of the charged toner.

6. A cleaning device according to claim 1, wherein the conductive member is a flicker metal rod.

7. A cleaning device according to claim 1, wherein, depending on the potential level of the photosensitive drum, a current flows from the first removing section into the non-linear resistor element, and wherein the current operates to create the bias potential of the first removing section.

8. A cleaning device for removing toner and paper dust remaining on a photosensitive drum in an image forming apparatus which forms an image using the photosensitive drum, the cleaning device comprising:

a roll-shaped electrically conductive brush grounded via a varistor to generate a bias potential whose polarity is the same as that of charged toner, for removing toner and paper dust remaining on the surface of the photosensitive drum;

an electrically conductive member which is put in pressure contact with the electrically conductive brush and connected via the varistor to have a potential equal to a potential of the electrically conductive brush; and a cleaning blade formed of an elastic material, which, following the electrically conductive brush, removes the toner remaining on the surface of the photosensitive drum.

9. A cleaning device according to claim 8, wherein the bias potential of the electrically conductive brush is substantially the same in voltage level as that of the charged toner.

10. A cleaning device according to claim 8, wherein the electrically conductive member is a flicker metal rod.

11. A cleaning device according to claim 8, wherein, depending on the potential level of the photosensitive drum, a current flows from the electrically conductive brush into the varistor, and wherein the current operates to create the bias potential of the electrically conductive brush.

12. A cleaning method for removing toner and paper dust remaining on a photosensitive drum in an image forming apparatus which forms an image using the photosensitive drum, the method comprising:

removing toner and paper dust remaining on a surface of the photosensitive drum, using a roll-shaped electrically conductive brush grounded via a varistor in order to generate a bias potential whose polarity is the same as that of charged toner;

connecting a conductive member which is put in pressure contact with the electrically conductive brush via the varistor to have the same potential as the electrically conductive brush; and removing the toner remaining on the surface of the photosensitive drum, using a cleaning blade formed of an elastic material.

* * * * *